US006745851B1

(12) United States Patent
Edvardsen

(10) Patent No.: US 6,745,851 B1
(45) Date of Patent: Jun. 8, 2004

(54) METHODS AND SYSTEM FOR PROCESSING OF DRILLING FLUID

(75) Inventor: Per Espen Edvardsen, Loddefjord (NO)

(73) Assignee: AGR Services AS, Straume (NO)

( * ) Notice: Subject to any disclaimer, the term of this patent is extended or adjusted under 35 U.S.C. 154(b) by 0 days.

(21) Appl. No.: 10/049,991

(22) PCT Filed: Aug. 14, 2000

(86) PCT No.: PCT/NO00/00263

§ 371 (c)(1),
(2), (4) Date: Apr. 11, 2002

(87) PCT Pub. No.: WO01/14688

PCT Pub. Date: Mar. 1, 2001

(30) Foreign Application Priority Data

Aug. 20, 1999 (NO) ..... 19994024

(51) Int. Cl.[7] ..... E21B 7/12
(52) U.S. Cl. ..... 175/5; 125/7; 125/66
(58) Field of Search ..... 175/5, 7, 8, 9, 175/10, 66; 166/368, 358

(56) References Cited

U.S. PATENT DOCUMENTS 4,096,737 A * 6/1978 Schuh ..... 73/46
4,149,603 A * 4/1979 Arnold ..... 175/7
6,062,313 A * 5/2000 Moore ..... 166/357
6,216,799 B1 * 4/2001 Gonzalez ..... 175/5

FOREIGN PATENT DOCUMENTS

EP 0290250 * 11/1988

* cited by examiner

*Primary Examiner*—William Neuder
(74) *Attorney, Agent, or Firm*—Francis C. Hand; Carella, Byrne, Bain etal

(57) ABSTRACT

A method and a system are described for processing of drilling fluid from a drilling hole (10) in an underwater well to a floating drilling rig or drilling vessel, comprising a sealing device (12) connected to a well head, a pump module (14) to transport drilling fluid, a treatment plant for treatment of drilling fluid, or a storage installation. Before a blow-out valve is connected to the well head and before a riser is connected between the drilling hole and the floating drilling rig or drilling vessel, the pump module (14) placed on the ocean bed transports drilling fluid from the drilling hold (10) on the ocean bed to the floating drilling rig or drilling vessel.

7 Claims, 2 Drawing Sheets

METHODS AND SYSTEM FOR PROCESSING OF DRILLING FLUID

The present invention relates to a method and a system for processing of drilling fluid from a drilling hole in an underwater well to a floating drilling rig or drilling vessel. In particular, the invention relates to processing of drilling fluid before a blow-out valve is connected to the drilling hole and a riser is connected between the drilling hole and the floating drilling rig or drilling vessel.

Today's demands relating to environmental discharges puts great demands on the operators in the oil industry. For example, some of the operators stipulate that there shall not be any discharge of drilling fluid during drilling. During drilling of a new oil well in the ocean bed, or drilling in an already existing well, large amounts of drilling fluid, which must be treated, are produced. This car be oil-based drilling fluid or water-based drilling fluid, depending on whether the drilling which is being carried out, is top-hole drilling or drilling in the coil zones.

In this application, drilling fluid is meant to be fluids which appear during drilling in a drilling hole, such as cuttings, drilling mud, or other drilling fluids.

In recent years, the environmental threats which the oil industry poses have been given increasingly more focus. The authorities have imposed increasingly stronger demands on care for the environment and have strict rules for discharges from offshore installations, as these can have negative effects on the maritime environment. Today, there are, in the main, strict restrictions with regard to discharges of oil-based drilling mud, and discharges of this type have almost been completely stopped in the Norwegian sector of the North Sea.

In a standard well, in which the following holes are drilled without risers (36"–225 m, 26"–1200 m), more than 340 $m^2$ of cuttings will be produced directly from the well. In addition, there is the drilling mud with its mixture of different chemicals. The Norwegian Pollution Control Authority (SFT) introduced a complete ban on dumping of drilling mud and/or drilling fluid in the Norwegian sector of the North Sea in 1993. This was the start of what is today called slurry-fixing plants, which are able to process the return of fluid to the drilling hole.

Today, most of the fixed installations have such plants, but they are only used for injection of oil-containing waste. The injection is carried out in an annular space between two casings in the drilling hole, normally casings with diameters of around 340 mm and 508 mm (13⅜" and 20"). This is based on a pump rate of about 4000 1/min under drilling of about a 311 mm (12½") section and about a 216 mm (8½") section.

Water-based drilling fluids are discharged directly to the sea and sink to the ocean bottom, something that creates environmental problems for the maritime life both in the ocean and at the ocean bottom. Discharges of drilling fluids can be carried out with the aid of a pump which is connected on a base at the drilling hole The pump acts as a suction pump to create a negative pressure in a sealing device which is arranged round the drill column in the drilling hole.

Disadvantages with today's methods are that if the water-based drilling fluid is to be transported up to the drilling rig to be injected into a corresponding well, many problems to which there are no solutions at present arise. For example, during top-hole drilling, there are no maritime risers, i.e. a vertical riser which transports drilling mud from the ocean bottom and up to the drilling platform, and in addition, there is no annular space for injection of the water-based drilling fluid.

U.S. Pat. No. 4,149,603 disclose a system and a method of underwater drilling operation, which returns drilling mud to the surface of the water, without the use of a riser, but after a BOP is installed. The system comprises e mud sump connected to the top of a submerged wellhead and pump means to pump mud through a hose and to the surface.

EP 0290250 discloses a method and apparatus for drilling sub sea wells at large depths, where drilling return mud is pumped to the surface by a centrifugal pump. The apparatus is attached to top of the blow-out preventer stack.

None of the prior art documents discloses methods or apparatuses adapted to be used before a riser is connected and a blow-out preventer is installed on the wellhead.

There is, therefore, a need for a method that can remove discharges of drilling fluid returns at a drilling rig or drilling vessel, and which can be applied in connection with the already existing drilling hole applications both on the ocean bottom and on the drilling rig, before both riser and blow-out preventer is installed. There is also a need for a system to carry out the method according to the present invention.

Advantages with the method according to the present invention are that great savings are achieved by being able to recirculate drilling fluid returns. Full drilling rate is maintained in the different sections, i.e. about 311 mm and about 216 mm (12¾" and 8½") sections. Moreover, the environment is spared from unnecessary discharges. A faster slurrification of the drilling fluid which is produced during drilling is also achieved, i.e. faster treatment of the pumpable fluid or mud which consists of a solid material sedimented in a fluid. Less strict demands for the slurry. No wearing of casings will occur, and there is no danger that the casing will be damaged. Drilling fluid is kept away from the template, i.e. the base, and no concrete is used around the template. This gives a clear view for the ROV operator (Remotely Operated Vehicle). A greater injection rate is also achieved. In addition, the drilling fluid can also be stored for later, to be transported away from the floating drilling rig.

In connection with drilling on the ocean bed, drilling fluid is formed around the drilling mould (template). It is normal to use remote controlled underwater vehicles (ROV-"remote operated vehicle") with a camera, to monitor and carry out various operations, and the drilling fluid/mud in the area around the drilling hole orifice represents, therefore, a considerable visual problem. Cuttings are fragments of rocks, which under drilling are brought up with the drilling mud.

The object of the prevent invention is, therefore, to provide a method and a system, which eliminates the above-mentioned problems. It is also an object to provide a method and a system of processing drilling fluid return from a drilling hole in an underwater well at a floating drilling rig or a drilling vessel, comprising a sealing device connected to a well head, and a pump module to transport drilling fluid, a treatment plant, or a storage installation, for drilling fluid and possibly an injection pump.

The method, according to the present invention, is characterised in that before a blow-out valve is connected to the well head, the submerged pump module and the sealing device provides an outlet pressure, dependent on the specific weight of the mud and the ocean depth, which is high enough for transportation of the drilling fluid from the drilling hole, through the return line and up to the floating drilling rig or drilling vessel.

The system, according to the present invention, is characterised in that a pump module, which is arranged on the ocean bed and connected to a sealing device, is adapted to transport drilling fluid from the drilling hole on the ocean bed, via a return line, to a treatment plant, or a storage installation, on the floating drilling rig or drilling vessel.

Preferred embodiments of the method, according to the present invention, are specified in that the pump nodule placed on the ocean bed and the sealing device provides an outlet pressure, dependent on the weight of the mud and ocean depth, which is high enough to transport drilling fluid from the drilling hole, through the return line and up to the floating drilling rig or drilling vessel. The drilling fluid is transported through the return line and to the existing line (flow-line) on the floating drilling rig or drilling vessel for further transport to the treatment plant or storage installation. After the cuttings is treated, using a method that may be known previously, on the floating drilling rig or drilling vessel, the treated cuttings is injected, with the aid of a high-pressure pump, into a second drilling hole provided on the ocean bed, or in an adapted annular space in the first drilling hole.

Preferred embodiments of the system are characterised in that the submerged pump module and the sealing device, before a blow-out valve is connected to the well head, are adapted to provide an outlet pressure which is high enough for transportation of the drilling fluid from the drilling hole, through the return line and up to the floating drilling rig or drilling vessel.

The pump module placed on the ocean bed comprises a number of pumps to provide the necessary pressure, such as a centrifuge and/or a friction pump possibly connected in series, where the pump, or pumps, is driven by a submerged electric motor which is connected to the pump or pumps.

A preferred embodiment, according to the present invention, shall now be described with reference to the enclosed figures. It must be understood that this example is not limiting and that other and further modifications may be carried out within the scope of the claims.

Figure 1:
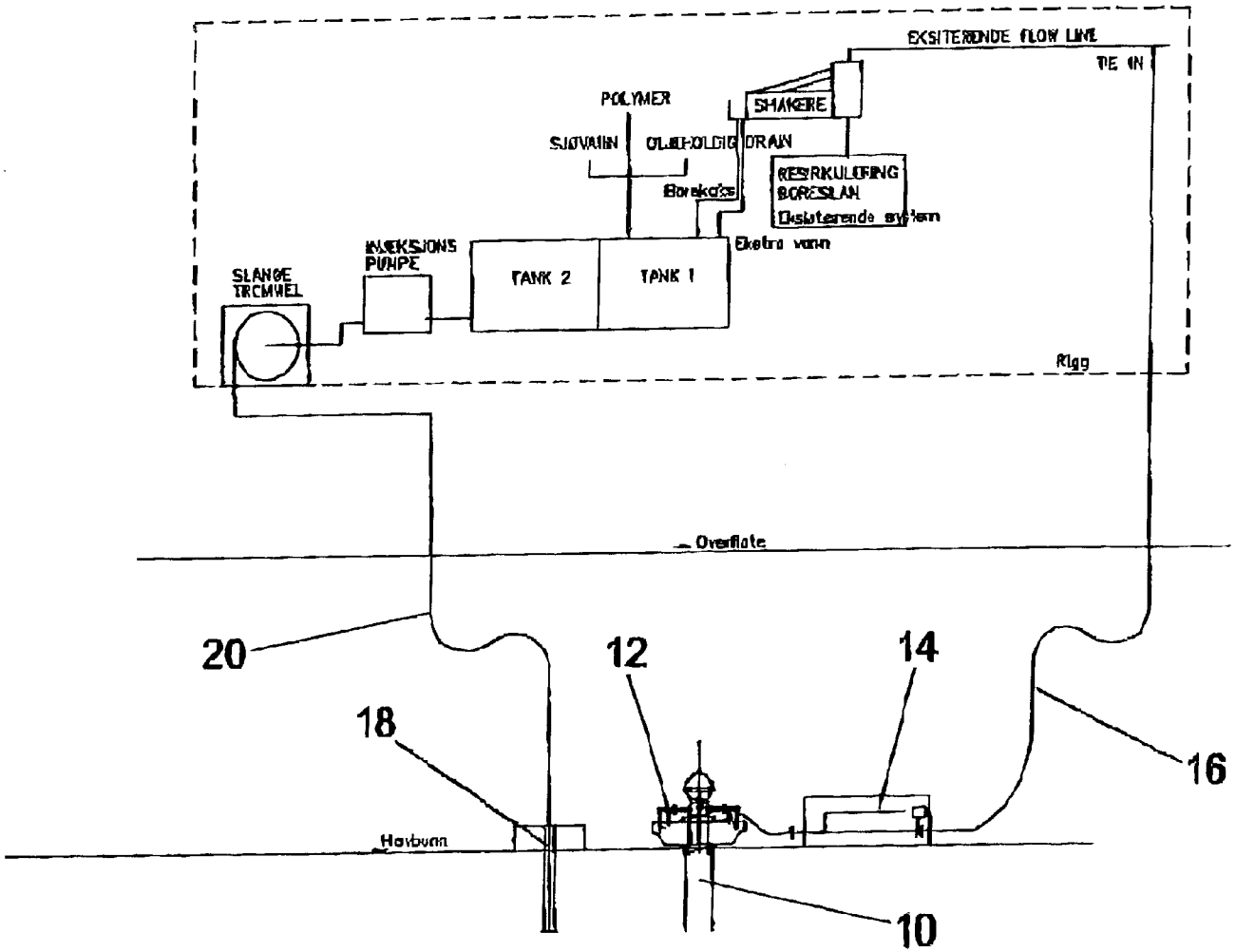
FIG. 1 shows a principle of the method and the system for processing of a drilling fluid according to the present invention.

To a first drilling hole 10 which is already drilled in the ocean bed, it is common to connect a sealing device 12, which normally is described as a suction and centralisation module (SCM), as shown in FIG. 1. This sealing device 12 is connected to the well head of the first drilling hole 10, for example, to form a seal between the foundation at the well head and a pipe string up to the drilling rig, and to create a negative pressure in the drilling hole for suction of drilling fluid.

The present invention applies, amongst other things, such a known system, with a sealing device for removal of drilling fluid from a drilling hole orifice, which is characterised in that between the inner surface of the casing and outer surface of the drilling column an end-piece which forms a seal, basically a watertight seal, is arranged between the casing and the drilling column, and that at least one exit passage is arranged in the casing which is connected directly to a line system whereupon a pump module, for example, can be connected. This system is based on the applicant's Norwegian patent application no. 19982394.

A pump module 14 is connected to this exit passage or outlet on the sealing device 12 for suction of drilling fluid/drilling mud. The outlet pressure is dependent on weight of mud and water depth. For example, at a water depth of 400 m and a mud weight of 1.7, the pressure will be approximately 22 bars, Because of the negative pressure in the well head 10 generated by the sealing device 12 and the pump module 14, a lifting height, including pressure drop and lifting reduction because of the weight of the slurry, is generated, sufficient to lift the drilling fluid up to an existing line on the drilling rig, for example an already existing "flow line", which is well known to those skilled in the art. Transport of the drilling fluid from the pump module 14 to the existing line can, for example, be carried out in a about 152 mm (6") or 203 mm (8") pipe/line 16 which is connected to the already existing line (flow line) on the drilling rig. The pipe 16 must be of a type which can withstand the working-pressure which is necessary to lift the slurry up to the floating drilling rig or drilling vessel.

The pump module comprises a pump of known type which can pump seawater, drilling fluid and cuttings under high pressure. At greater depths, it may be necessary with a multi-step solution, for example, two or more pumps connected in series, to obtain the required pressure The pump is arranged as a module which can be tested and thereafter lowered down to the ocean bed ready for use after pipes have been connected to the inlet and outlet. To reduce the weight and dimensions, it seems sensible to use a centrifugal and/or friction pump driven by a submerged electric motor, which is connected directly to the pump. The power supply can be arranged in a compounded umbilical cord (umbilical), which can also be used to lower the pump down to she ocean bed.

After transport of the drilling fluid to the floating drilling platform or drilling vessel, the drilling fluid is thereafter led to a treatment plant, or alternatively, a storage installation on the floating drilling rig or drilling vessel for further transport to another treatment plant or storage installation.

The treatment plant on the floating drilling rig or drilling vessel comprises, for example, a shaking unit shaker), a first storage tank, a mixing tank, a crushing unit, other storage tanks, and a high-pressure injection pump, etc.

The water-based drilling mud is strained in the shaking unit. Extra seawater is strained and returned to a storage tank, for mixing of slurry for injection. When this method is used, approximately 80 to 90% of the water-based drilling mud can be recirculated. This gives very large cost savings per day during, for example, top-hole drilling. After the drilling fluid has been strained in the shaking unit, it is transported to a tank which comprises a number of crushing units or crushing pumps. The slurry is crushed in the crushing units or crushing pumps to a preferred particle size of around 10 to 20 $\mu$, or another suitable size, whereupon the matter is pumped to a storage tank before it is transferred to an injection unit, such as for example a high-pressure pump, for injection into a second drilling hole 18. This injection can, for example, be carried out in a 102 mm (4") injection tube 20 with a working pressure of between approximately 35–150 bars.

Figure 2:
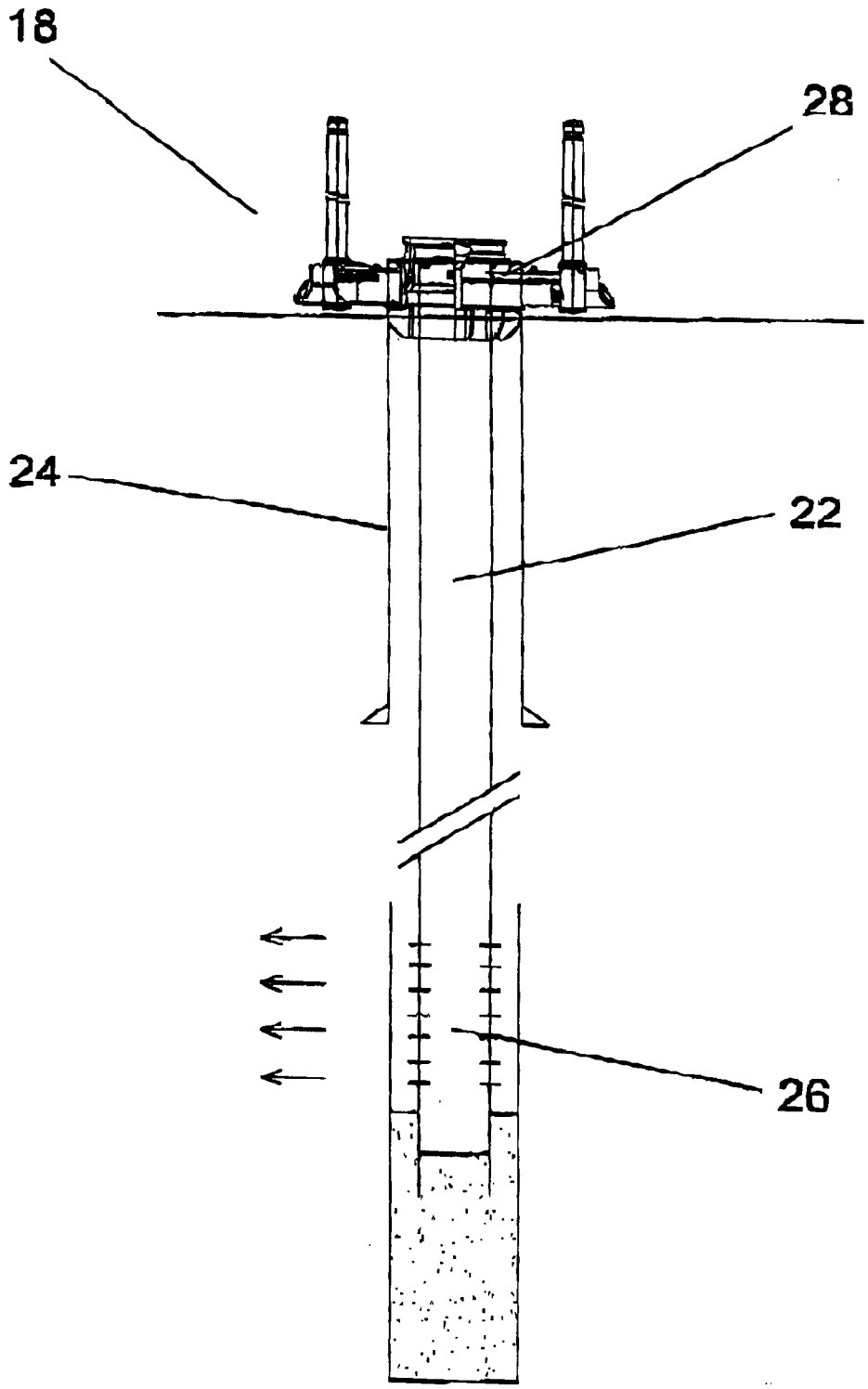
FIG. 2 shows a section of an injection well according to FIG. 1.

The methods according to the present invention, can also include that an injection well is drilled at a distance from the first drilling hole 10. An example of a new injection well is shown in FIG. 2, and can, for example, be a well 18 which is drilled for placing of a 178 mm. (7") casing 22 in a 340 mm (13⅜") casing 24, with, for example, a well depth of approximately 500 to 1500 m. This well depth can also vary, depending on the formation which is being drilled, and how receptive the formation is to the drilling fluid which is to be injected. An area 26 of the lower part of the inner casing is perforated for injection of the water-based drilling fluid.

Injection of the drilling fluid can also be performed in the first drilling hole (10), in a suitable annular space which may be between the casing and formation.

The drilling fluid, which is stored in the storage tank on the drilling rig, is injected with by the high-pressure pump, and through a wellhead system which is connected onto he well. This wellhead system can be of a type which, for example, gives a wear-free injection and which also increase the capacity of the injection.

In principle, the treatment plant can be placed at an arbitrary place as long as the drilling fluid can be pumped to the treatment plant and the drilling fluid can be injected into the second drilling hole. In the first example conducted, the treatment plant is placed on the drilling rig, because the already existing treatment plant is normally installed there, but the treatment plant for the drilling fluid can, off course, be placed somewhere else.

Thus, a new method and system for transport drilling fluid from a drilling hole on the ocean bed to a floating drilling rig or drilling vessel is provided, improving the environment in the sea.

What is claimed is:

1. A system for processing drilling fluid during top-hole drilling in underwater drilling operations comprising:

a sealing device for mounting over a drilling hole in sealed relation to the surroundings seawater to prevent leakage of drilling fluid from the drilling hole;

a floating drilling vessel having at least one of a treatment plant for treating drilling fluid and a storage installation to receive drilling fluid;

at least one pump module spaced from and connected to said sealing device to effect a differential pressure therein for pumping drilling fluid from said sealing device upwardly to said at least one of said treatment plant and said storage installation on said vessel; and a line extending from said pump module upwardly to said at least one of a treatment plant and a storage installation on said vessel to convey the drilling fluid from said pump module to said at least one of a treatment plant and a storage installation on said vessel.

2. A system as set forth in claim 1 wherein said sealing device and said pump module are interconnected to form a suction and centralizaton module.

3. A system as set forth in claim 1 further comprising a submerged electric motor operatively connected to said pump to drive said pump.

4. A system as set forth in claim 1 wherein said pump generates an outlet pressure dependent on the ocean depth and weight of the drilling fluid sufficient to transport the drilling fluid to said drilling vessel.

5. A method of processing drilling fluid from a drilling hole in an ocean bed during top-hole drilling before a blowout preventer is installed and a riser connected between the blowout preventer and a drilling vessel, said method comprising the steps of:

mounting a sealing device over the drilling hole in sealed relation to the surroundings seawater;

mounting at least one pump module in spaced relation to and connected to said sealing device to effect a differential pressure therein;

providing an outlet pressure for the drilling fluid based on said differential pressure and the specific weight of mud to be transported and the ocean depth; and pumping drilling fluid from the sealing device into a line extending upwardly to at least one of a treatment plant and a storage installation on a said floating drilling vessel.

6. A method as set forth in claim 5 which further comprises the step of returning the drilling fluid from the drilling vessel into the drilling hole.

7. A method as set forth in claim 5 which further comprises the step of directing the drilling fluid from the drilling vessel into the ocean bed in spaced relation to the drilling hole for injection into a further drilling hole.

* * * * *

UNITED STATES PATENT AND TRADEMARK OFFICE

CERTIFICATE OF CORRECTION

PATENT NO. : 6,745,851 B1
DATED : June 8, 2004
INVENTOR(S) : Per Espen Edvardsen It is certified that error appears in the above-identified patent and that said Letters Patent is hereby corrected as shown below:

Column 1,
Line 16, “car” should be -- can --

Column 5,
Line 1, “he” should be -- the --

Column 6,
Line 26, change “on a” to -- on --

Signed and Sealed this

Thirty-first Day of August, 2004

JON W. DUDAS
*Director of the United States Patent and Trademark Office*

US006745851C1

(12) EX PARTE REEXAMINATION CERTIFICATE (7585th)

United States Patent
Edvardsen

(10) Number: US 6,745,851 C1
(45) Certificate Issued: Jun. 29, 2010

(54) METHODS AND SYSTEM FOR PROCESSING OF DRILLING FLUID

(75) Inventor: Per Espen Edvardsen, Loddefjord (NO)

(73) Assignee: AGR Services AS, Straume (NO)

Reexamination Request:
No. 90/009,568, Aug. 27, 2009

Reexamination Certificate for:

| | |
|---|---|
| Patent No.: | **6,745,851** |
| Issued: | **Jun. 8, 2004** |
| Appl. No.: | **10/049,991** |
| Filed: | **Apr. 11, 2002** |

Certificate of Correction issued Aug. 31, 2004.

(22) PCT Filed: Aug. 14, 2000

(86) PCT No.: PCT/NO00/00263

§ 371 (c)(1),
(2), (4) Date: Apr. 11, 2002

(87) PCT Pub. No.: WO01/14688

PCT Pub. Date: Mar. 1, 2001

(30) Foreign Application Priority Data

Aug. 20, 1999 (NO) ..... 19994024

(51) Int. Cl.
*E21B 7/12* (2006.01)

(52) U.S. Cl. ..... 175/5; 175/7; 175/66

(58) Field of Classification Search ..... None
See application file for complete search history.

(56) References Cited

U.S. PATENT DOCUMENTS 6,325,159 B1 12/2001 Peterman
6,454,022 B1 9/2002 Sangesland

*Primary Examiner*—Joseph A. Kaufman

(57) ABSTRACT

A method and a system are described for processing of drilling fluid from a drilling hole (10) in an underwater well to a floating drilling rig or drilling vessel, comprising a sealing device (12) connected to a well head, a pump module (14) to transport drilling fluid, a treatment plant for treatment of drilling fluid, or a storage installation. Before a blow-out valve is connected to the well head and before a riser is connected between the drilling hole and the floating drilling rig or drilling vessel, the pump module (14) placed on the ocean bed transports drilling fluid from the drilling hold (10) on the ocean bed to the floating drilling rig or drilling vessel.

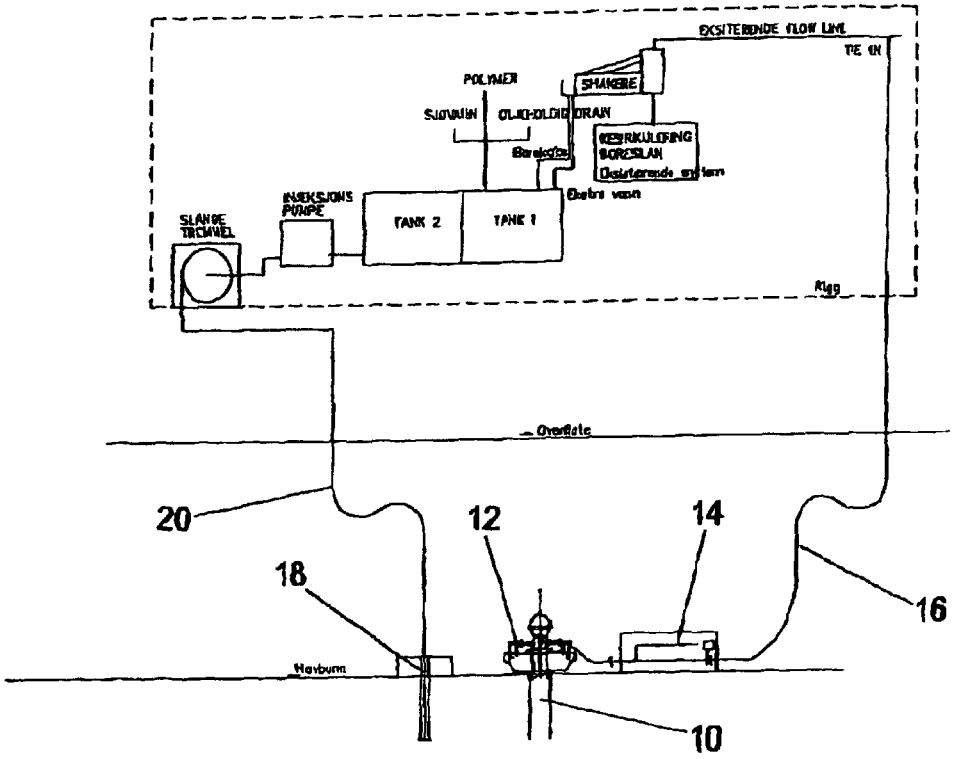

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-7 is confirmed.

New claim 8 is added and determined to be patentable.

*8. A system for processing drilling fluid from a drilling hole in an ocean bed during top-hole drilling in underwater drilling operations comprising:*

*a sealing device for connection to a well head mounted over a drilling hole in an ocean bed during top-hole drilling and before a blowout preventer is installed and a riser connected between the blowout preventer and a drilling vessel, said sealing device being in sealed relation to the surrounding seawater to prevent leakage of drilling fluid from the drilling hole to the surrounding seawater, while creating a negative pressure in the drilling hole for suction of drilling mud therefrom;*

*a floating drilling vessel having at least one of a treatment plant for treating drilling fluid and a storage installation to receive drilling fluid;*

*at least one pump module spaced from and connected to said sealing device to effect a differential pressure therein for pumping drilling fluid from said sealing device upwardly to at least one of said treatment plant and said storage installation on said vessel; and*

*a line extending directly from said pump module upwardly to said at least one of a treatment plant and a storage installation on said vessel to convey the drilling fluid from said pump module to said at least one of a treatment plant and a storage installation on said vessel.*

* * * * *